US007632126B1

(12) United States Patent
Farole et al.

(10) Patent No.: US 7,632,126 B1
(45) Date of Patent: Dec. 15, 2009

(54) HIGH DENSITY CIRCULAR INTERCONNECT WITH BAYONET ACTION

(75) Inventors: Dominic Anthony Farole, Hummelstown, PA (US); Keith Edwin Miller, Manheim, PA (US); Kenneth R. Gleason, Harrisburg, PA (US); John K. Knoll, Lebanon, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/126,716

(22) Filed: May 23, 2008

(51) Int. Cl.
*H01R 13/00* (2006.01)

(52) U.S. Cl. ..... 439/314

(58) Field of Classification Search ..... 439/310, 439/318, 314, 357, 372, 680, 541.5, 352
See application file for complete search history.

(56) References Cited

U.S. PATENT DOCUMENTS 3,848,950 A 11/1974 McCormick et al
4,629,272 A * 12/1986 Mattingly et al. ..... 439/318
4,744,770 A * 5/1988 Drogo ..... 439/318
5,501,612 A * 3/1996 Green ..... 439/499
5,637,010 A 6/1997 Jost et al.
6,749,463 B1 * 6/2004 Fan ..... 439/607
6,846,996 B2 1/2005 Kent et al.
6,875,037 B2 4/2005 Collin et al.
7,075,023 B2 7/2006 Kent et al.
7,160,151 B1 * 1/2007 Rigby et al. ..... 439/607
7,256,362 B2 8/2007 Kent et al.
7,273,992 B2 9/2007 Kent et al.
7,354,282 B2 * 4/2008 Margulis et al. ..... 439/79
2007/0149011 A1 6/2007 Kent et al.

FOREIGN PATENT DOCUMENTS

WO 2004057630 A2 7/2004
WO 2004075349 A2 9/2004

* cited by examiner

*Primary Examiner*—Alexander Gilman

(57) ABSTRACT

A high density electrical interconnect is disclosed that uses a bayonet action to mate a plug having a plurality of contacts to receptacle having a plurality of spring contacts. The plurality of contacts may be a plurality of pin contacts, printed circuit board traces, or flexible film contacts. The spring contacts are preloaded to reduce the insertion force required to mate the plug and receptacle.

16 Claims, 17 Drawing Sheets

HIGH DENSITY CIRCULAR INTERCONNECT WITH BAYONET ACTION

FIELD OF THE INVENTION

The present invention relates generally to electrical connectors, and more particularly, to a coupling mechanism and contact configuration for an electrical connector having a high density of contacts.

BACKGROUND OF THE INVENTION

High density electrical connectors having a large number of contacts are used in a wide variety of applications. High density connectors are desirable because they reduce connector sizes, thereby requiring less overall space and eliminating excess bulk. This is highly advantageous in many applications, such as medical, aircraft and aerospace applications, where cost, space and weight savings are at a premium. A typical type of electrical connector assembly of the character described is a circular connector assembly which includes a male plug connector and a female receptacle connector. A coupling ring is rotatably mounted about one of the connectors for rotatably coupling the connectors in mating interengagement. The coupling system may utilize, for example, bayonet type or screw-thread type shells. Small high density contacts interconnect when the plug and receptacle connectors are rotatably mated.

As the density and number of electrical contacts used in such applications increases, problems arise upon mating of the connectors due to the high insertion force required to mate the high number of contacts. The high insertion forces required to mate the high number of contacts, especially in environments where the connectors are not easily accessed, or in a blind mating condition, or where the connectors must be cycled repeatedly, or where cost must keep the design complexity of the connector to a minimum, has presented a problem for current connector design. Therefore, there is a need for an improved high density connector having lower required insertion force during mating.

SUMMARY OF THE INVENTION

In an exemplary embodiment of the invention, an electrical connector is disclosed that includes a plug and a receptacle. The plug includes a plug housing having a plug contact sub-assembly support structure, at least one plug contact sub-assembly disposed within the plug contact sub-assembly support structure, a plug housing shell attached to a rear portion of the plug housing and disposed around the plug contact sub-assembly support structure, and a plurality of contacts received and supported in the plug contact sub-assembly. The receptacle includes a receptacle housing having a receptacle contact sub-assembly support structure, a receptacle contact sub-assembly disposed within the receptacle contact sub-assembly support structure, a receptacle housing shell attached to a rear portion of the receptacle housing, and a plurality of spring contacts received and supported in the receptacle contact sub-assembly. The plurality of spring contacts may be preloaded with an opening force.

The plug may further include bayonet slots disposed upon an outer surface of the plug housing, and the receptacle may further include a coupling ring disposed around the receptacle housing. The bayonet slots and coupling ring are configured to axially draw the plug into a fully mated position with the receptacle when the coupling ring is rotated.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
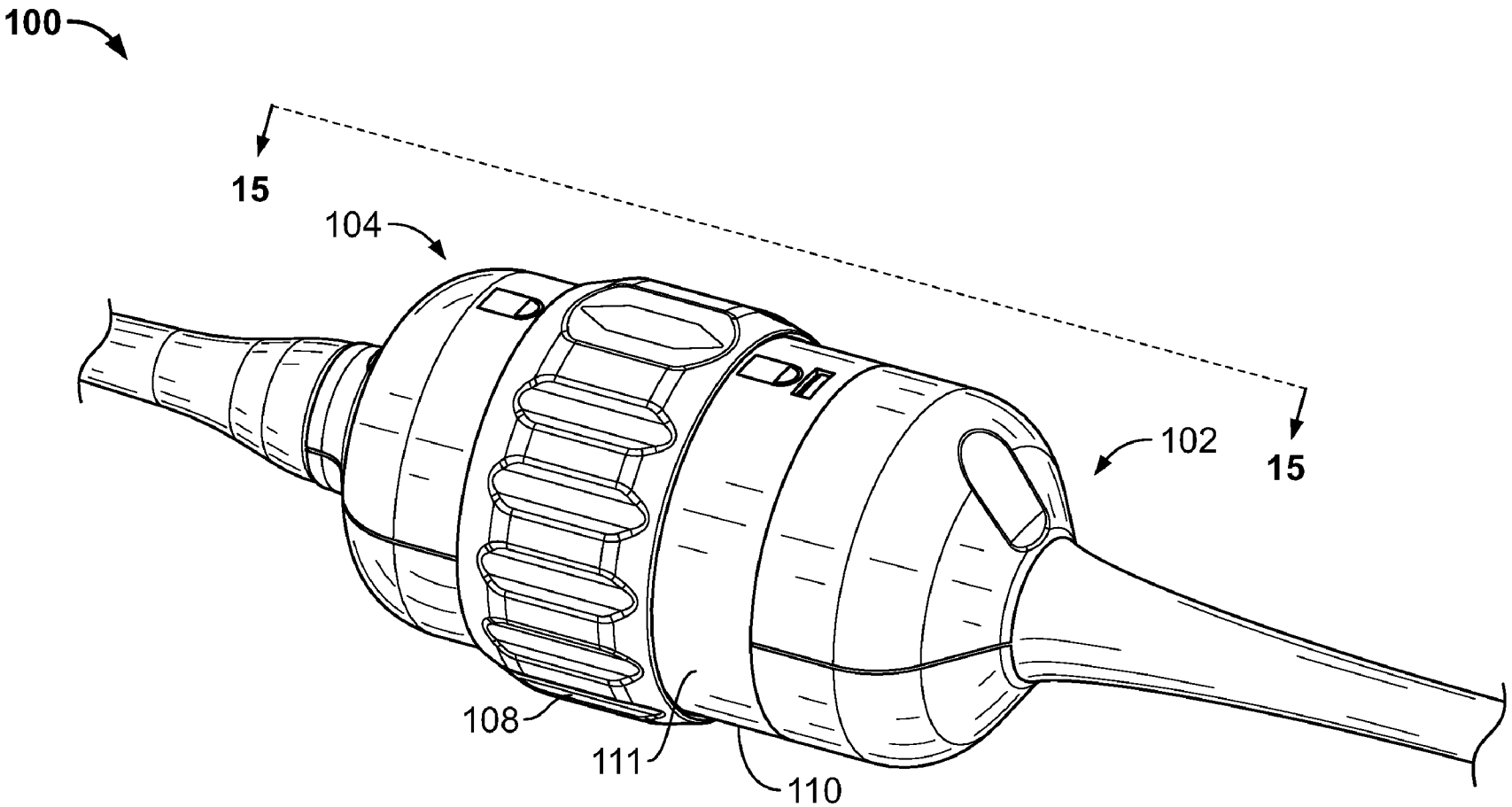
FIG. 1 is a perspective view of an exemplary mated electrical connector according to the invention.
Figure 2:
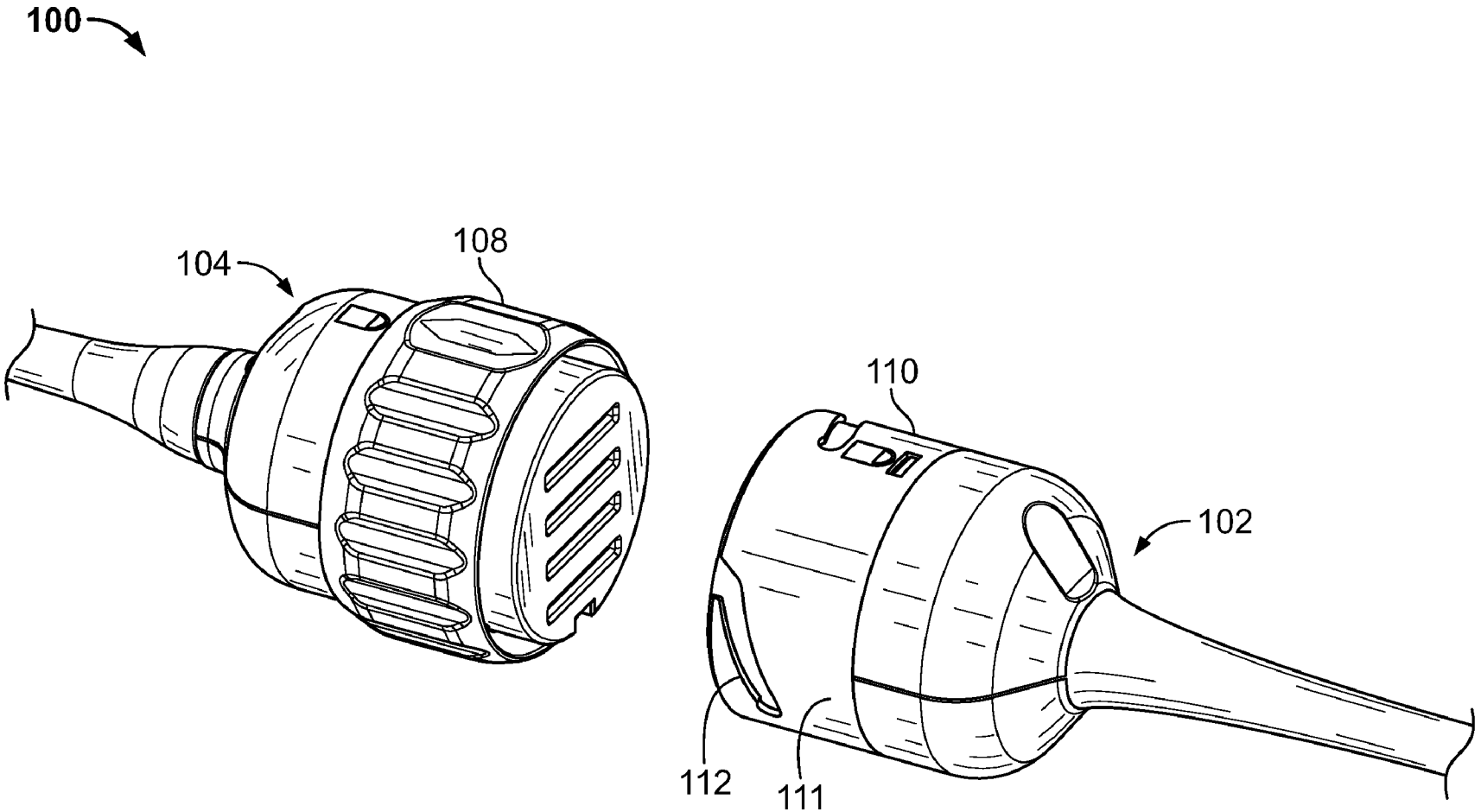
FIG. 2 is a perspective view of the unmated electrical connector of FIG. 1.

An exemplary embodiment of an electrical connector 100 according to the present invention is shown in FIGS. 1 and 2. The electrical connector 100 is shown mated in FIG. 1 and unmated in FIG. 2. The electrical connector 100 includes a plug 102 and a receptacle 104. The plug 102 and receptacle 104 are configured to be releasably mated, as will be described in further detail below. The plug 102 and receptacle 104 are mechanically coupled by the use of a coupling ring 108 carried by the receptacle 104. The plug 102 includes a plug housing 110 having an outer surface 111. The outer surface 111 has bayonet slots 112 (two additional bayonet slots are equally radially spaced, but not shown, on the housing 110) disposed thereupon for receiving corresponding bayonet pins 113 (FIG. 12) disposed within the coupling ring 108 as would be appreciated by one of ordinary skill in the art. In this exemplary embodiment, the housing 110 has three radially disposed bayonet slots 112 and corresponding bayonet pins 113, however, other embodiments may use one or more bayonet slots 112 and corresponding bayonet pins 113 to secure the plug 102 and receptacle 104. The plug 102 is drawn axially into fully mated engagement with the receptacle 104 as shown in FIG. 2 by engagement between the bayonet pins 113 of the coupling ring 108 and the bayonet slots 112 of the plug 102 as the coupling ring 108 is rotated. In other embodiments, other locking and/or camming mechanisms may be used in place of the coupling ring 108 and bayonet slots 112 to secure and/or assist in the mating of the plug 102 and receptacle 104. The non-conductive components of the electrical connector may be molded from any thermoplastic or similar material as would be appreciated by one of ordinary skill in the art. Additionally, any conductive component may be formed from any conductive material as would be appreciated by one of ordinary skill in the art.

Figure 3:
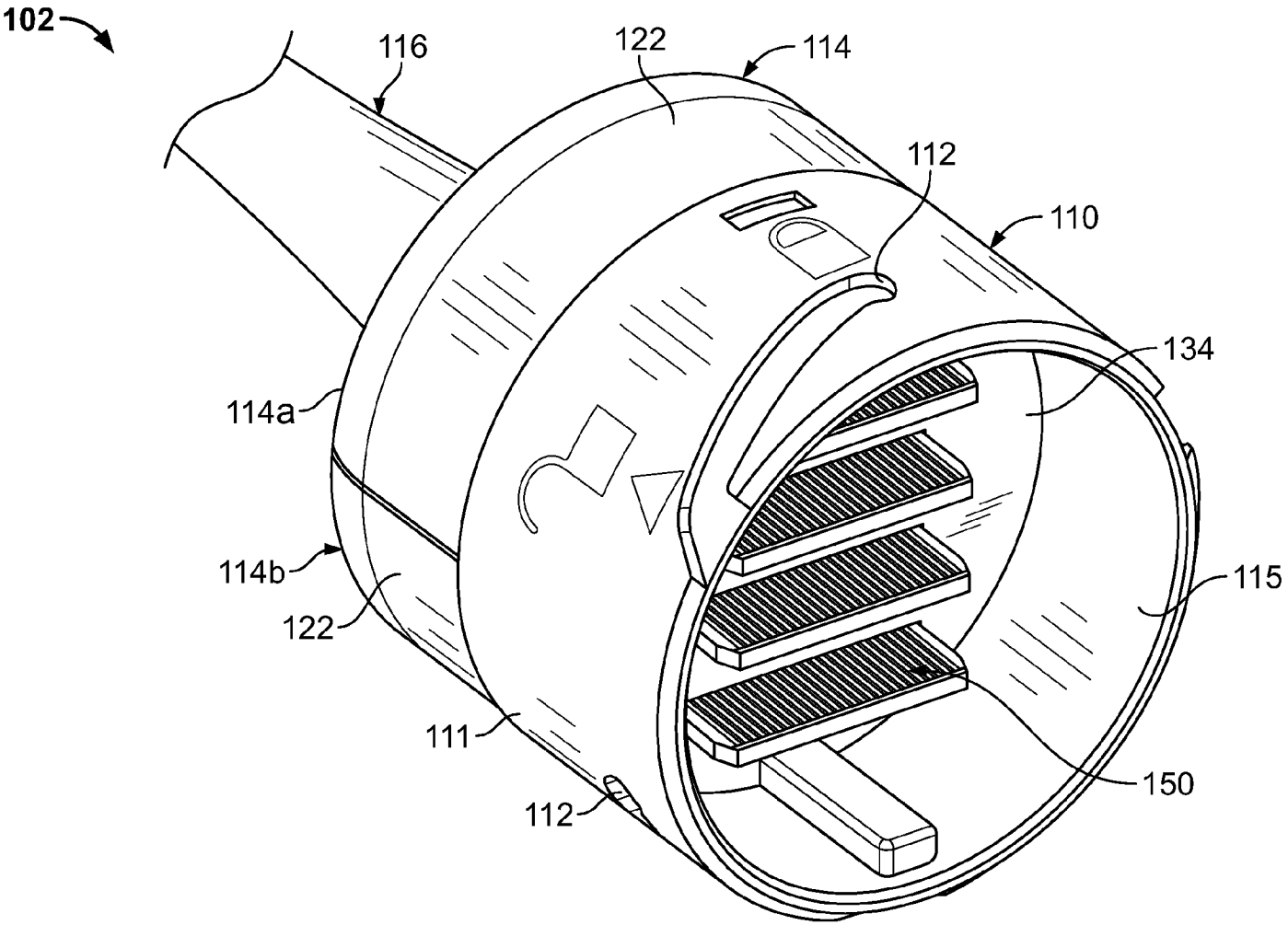
FIG. 3 is a perspective view of an exemplary embodiment of plug according to the invention.
Figure 4:
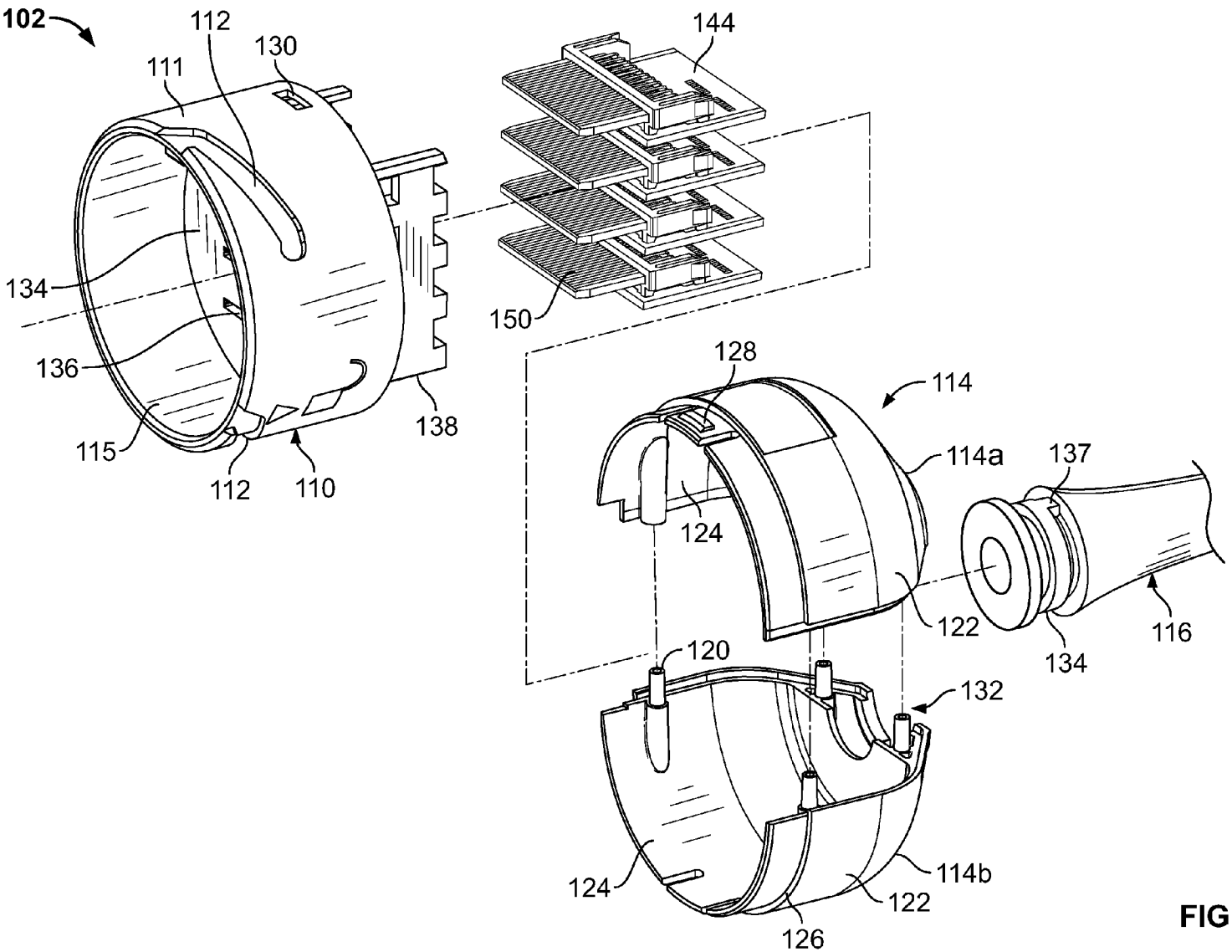
FIG. 4 is an exploded view of the plug of FIG. 3.

FIGS. 3 and 4 show plug 102 in greater detail. The plug 102 includes a plug housing 110, a plug housing shell 114, a flexible cable connector 116, and at least one plug contact sub-assembly 144. The plug housing shell 114 includes a first plug housing shell portion 114*a* and a second plug housing shell portion 114*b*. The second plug housing shell portion 114*b* includes posts 120 and the first plug housing shell portion 114*a* includes corresponding openings (not shown) for securing the second plug housing shell portion 114*b* to the first plug housing shell portion 114*a*. In alternative embodiments, the first plug housing shell portion 114*a* and the second plug housing shell portion 114*b* may be provided with any corresponding combinations of tabs, slots, pins, screws, openings or other similar fasteners to secure the first plug housing shell portion 114*a* and the second plug housing shell portion 114*b* together as would be appreciated by one of ordinary skill in the art. In another embodiment, the plug housing shell 114 may be a single molded structure.

The plug housing shell 114 further includes an outer surface 122 and an inner surface 124. The plug housing shell 114 also includes a front engaging portion 126 having tabs 128 disposed thereupon (a similar tab 128 is present but not shown on the opposite side of the plug housing shell 114). The tabs 128 engage corresponding slots 130 (a similar slot 130 is present but not shown on the opposite side of the plug housing 110) in the plug housing 110 to secure the plug shell housing 114 to the plug housing 110. In alternative embodiments, the plug housing shell 114 and the plug housing 110 may be provided with any corresponding combinations of tabs, slots, pins, openings or other similar fasteners to secure the plug housing 110 and the plug housing shell 114 together as would be appreciated by one of ordinary skill in the art. Furthermore, in other embodiments, the engaging portion 126 may be provided over the plug housing 110 instead of being received within the plug housing 110 as in the exemplary embodiment.

The plug housing shell 114 further includes a rear opening 132 for receiving and securing flexible cable connector 116. In this exemplary embodiment, the flexible cable connector 116 includes a generally circular groove 134 that is secured in the rear opening 132 when the first shell portion 114*a* and the second shell portion 114*b* are assembled to each other. The flexible cable connector 116 may be of any length, and may be terminated and/or connected to another electrical device or connection (not shown) as would be appreciated by one of ordinary skill in the art. In another embodiment, the flexible cable connector 116 and the plug housing shell 114 may be otherwise configured with clamps, pins, slots or other fasteners to secure the flexible cable 116 to the plug housing shell 114. Additionally, while the rear opening 132 and groove 134 are shown having a generally circular geometry, it should be appreciated by one of ordinary skill in the art that the rear opening 132 and groove 134 may have any shape, including, but not limited to square, rectangular, and oval. In addition, flexible cable connector 116 may include a keying feature 137. In operation, a cable or wire having a plurality of conductors (not shown) would be provided through the flexible cable connector 116 and terminated to pads, traces, the plurality of contacts 150 (FIG. 3) and/or other termination features on a surface including a top surface, bottom surface and/or edge surface as would be appreciated by one of ordinary skill in the art.

Figure 5:
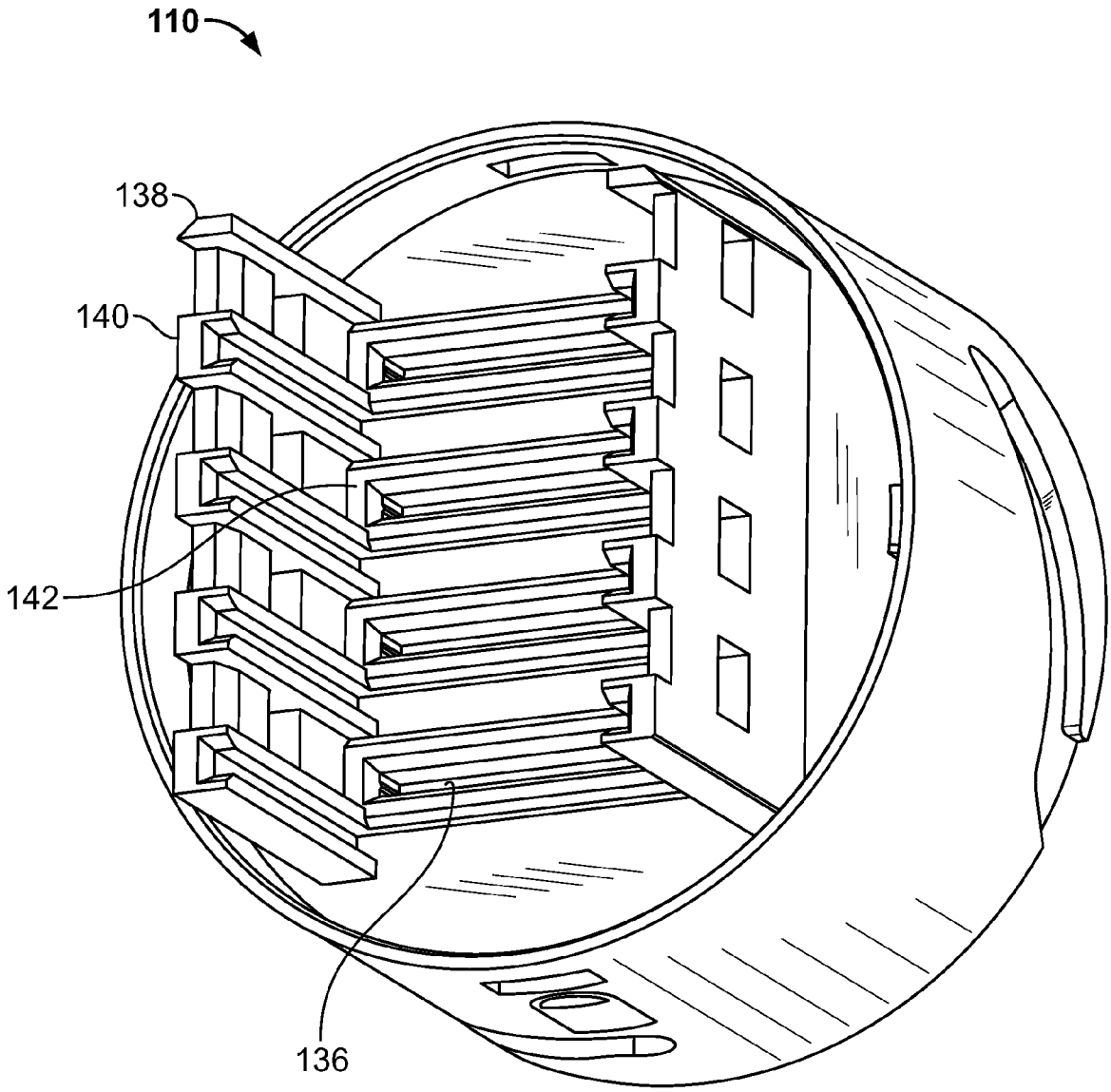
FIG. 5 is a rear view of the plug housing of the plug of FIG. 4.

As can be further seen in FIGS. 3 and 4, the plug housing 110 further includes a front plug housing surface 134 having contact assembly slots 136 therethrough, and a contact sub-assembly support structure 138. A rear view of the plug housing 110 showing greater detail of the contact assembly support structure 138 is shown in FIG. 5. As can be seen in FIG. 5, the contact assembly support structure 138 includes guide rails 140 and slot supports 142 configured to receive and support plug contact sub-assemblies 144. In this exemplary embodiment, the plug 102 contains four contact sub-assemblies 144, and the contact assembly support structure 138 is configured with guide rails 140 and a slot support 142 to support each contact sub-assembly 144. In another embodiment, the plug housing 110 may be provided with one or more slots 136, with guide rails 140 and slot supports 142 to receive and support a corresponding number of slots 136. In yet another embodiment, not all slots 136, guide rails, and slot supports 142 may necessarily support a sub-assembly 144, or in other words, be left open. In another embodiment, interior surfaces 115 of the plug housing 110, including the front plug housing surface 134 and the contact assembly support structure 138 may be plated with an electrically shielding material.

Figure 6:
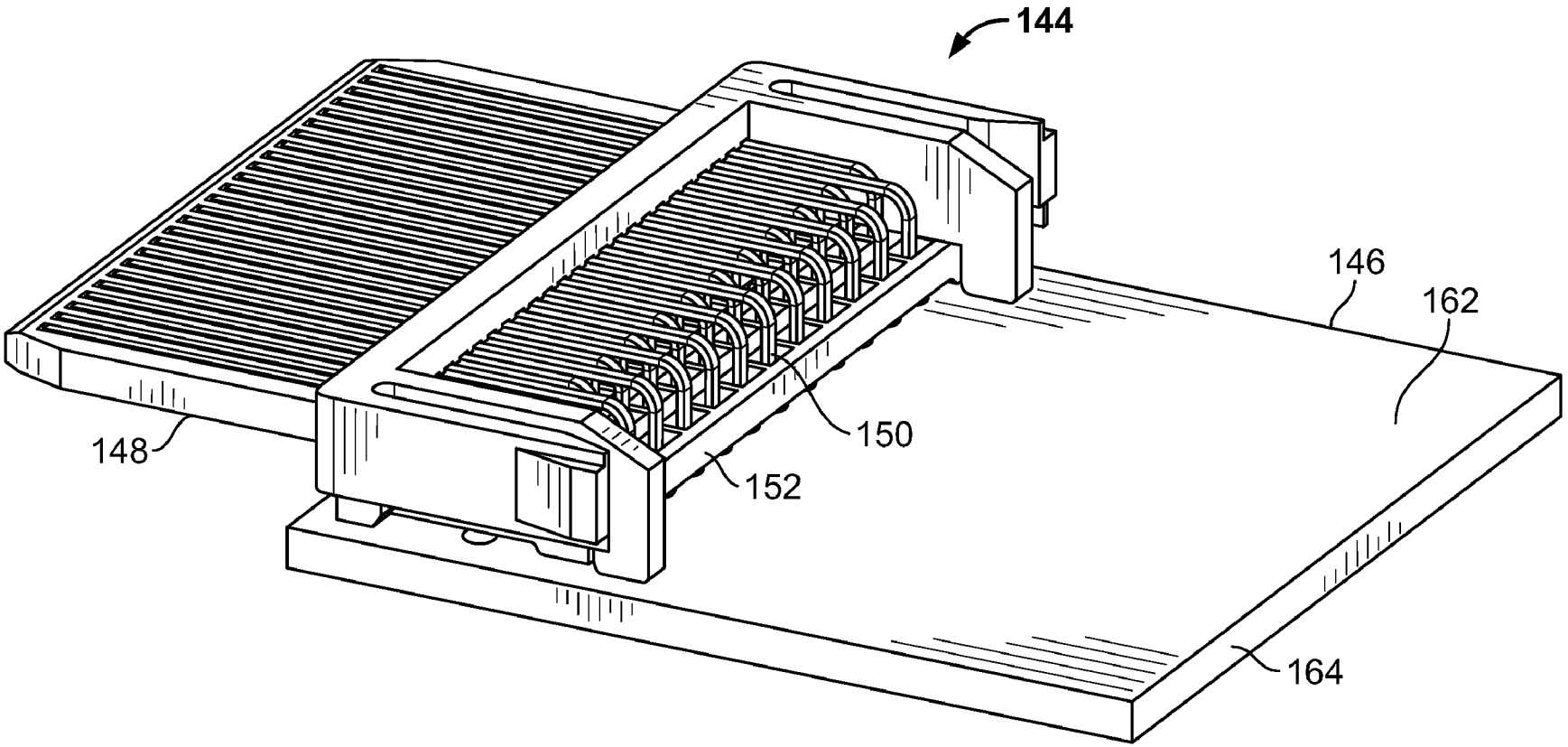
FIG. 6 is a perspective view of the plug contact sub-assembly of FIG. 4.
Figure 7:
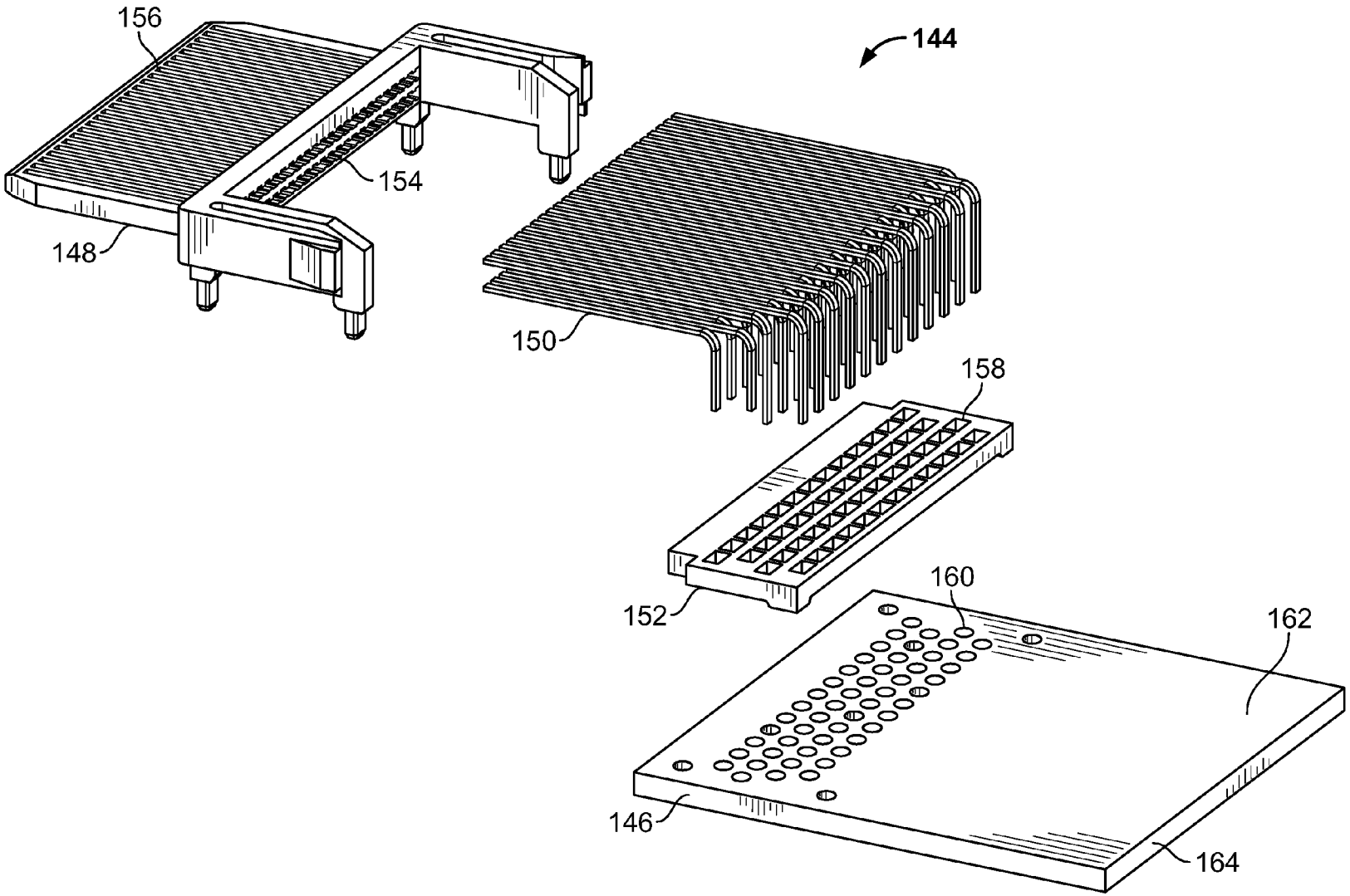
FIG. 7 is an exploded view of the plug contact sub-assembly of FIG. 6.

A plug contact sub-assembly 144 is shown in greater detail in FIGS. 6 and 7. The plug contact sub-assembly 144 includes a plug sub-assembly base 146, a plug contact support housing 148, a plurality of plug contacts 150, and a plug contact alignment spacer 152. In this exemplary embodiment, the plurality of plug contacts 150 are a plurality of stitched contacts, however, in other embodiments of the invention described below, other contacts which may be used in the invention as described. The plug sub-assembly base 146 may be a printed circuit board. The plug contact support housing 148 includes a plurality of openings 154 and a plurality of micro-channels 156 for receiving and supporting the plurality of contacts 150, respectively. The plurality of plug contacts 150 are further received through another plurality of openings 158 in the plug contact alignment spacer 152 prior to the plurality of plug contacts 150 being received through yet another plurality of openings 160 in the plug sub-assembly base 146. The plug contact alignment spacer 152 serves as an alignment aid for receiving and retaining the plurality of plug contacts 150 in the plug sub-assembly base 146. In another embodiment, the plug contact alignment spacer 152 may be formed by overmolding the plug contacts 150 to form a plug contact alignment spacer assembly (not shown) including the plurality of contacts 150. After the plurality of plug contacts 150 are received through the plurality of openings in the plug sub-assembly base 146, the plurality of plug contacts 150 are terminated to pads, traces or other conductive paths (not shown) of the plug sub-assembly base 146. The conductive paths may be present on a top surface 162, a bottom surface (not shown), and interior surface (not shown), an edge surface 164, or any combination thereof of the plug sub-assembly base 146. A plurality of conductors (not shown) provided to the plug 102 through the flexible cable connector 116 are correspondingly terminated to the conductive paths and/or plurality of contacts 150 as would be appreciated by one of ordinary skill in the art.

Figure 8A:
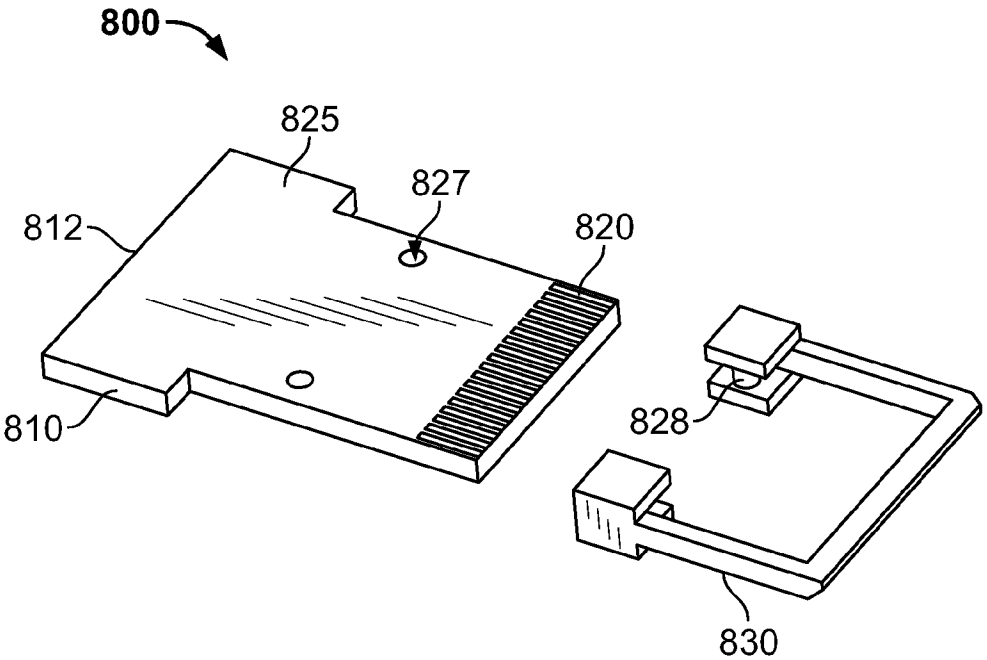
FIG. 8A is an exploded view of the contact sub-assembly of FIG. 8.
Figure 8:
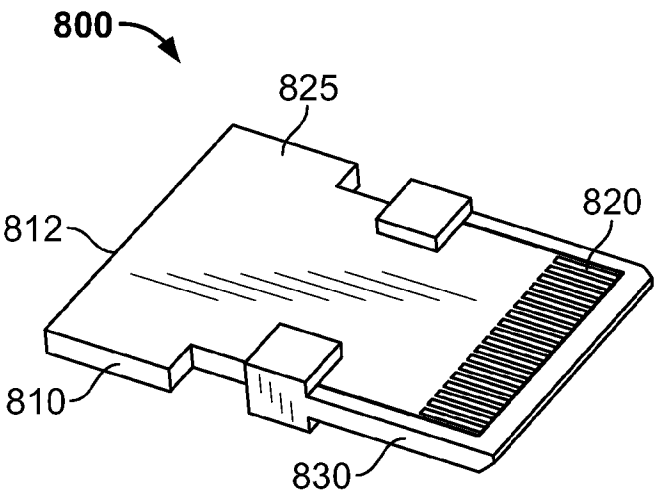
FIG. 8 is a perspective view of another exemplary plug contact sub-assembly according to the invention.

FIGS. 8 and 8A show another exemplary plug contact sub-assembly 800 that may be used with the plug 102. Plug contact sub-assembly 800 includes a printed circuit board (PCB) 810 and an optional overmold 830. The PCB includes a plurality of contacts 820 disposed on a top surface 825. The plurality of contacts 820 are terminated to pads, traces or other conductive paths (not shown) of the PCB 810. The conductive paths may be present on a top surface 825, a bottom surface (not shown), and interior surface (not shown), an edge surface 812, or any combination thereof. A plurality of conductors (not shown) provided to the plug 102 through the flexible cable connector 116 are correspondingly terminated to the conductive paths and/or plurality of contacts 820 as would be appreciated by one of ordinary skill in the art. The PCB 810 includes through holes 827 for receiving projections 828 of the overmold 830 to attach to the overmold 830 to the PCB 810. Overmold 830 protects the plurality of spring contacts 200 (FIG. 14B) from damage and wear during the mating and unmating of the plug 102 and the receptacle 104.

Figure 9:
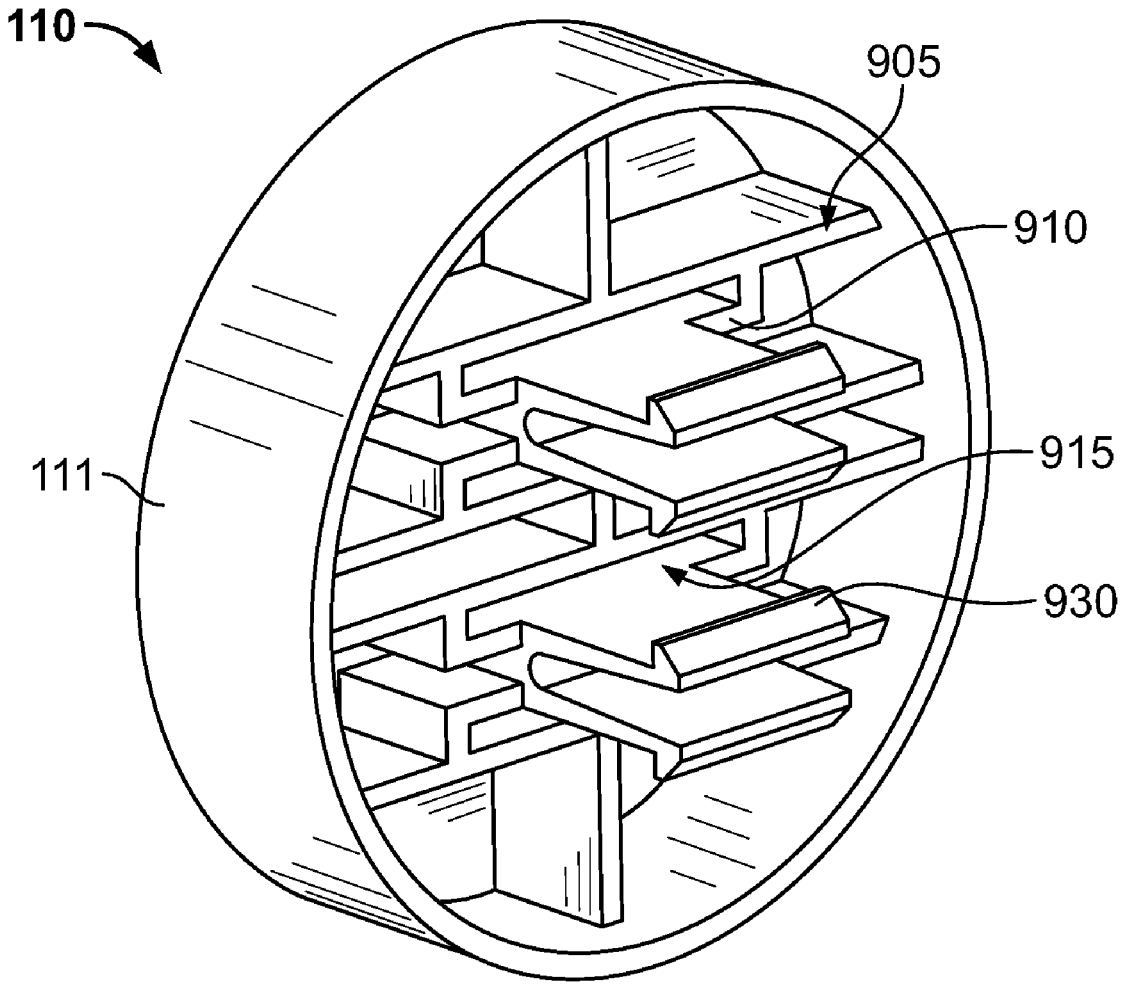
FIG. 9 is a rear view on another exemplary plug housing according to the invention.

In order to use the plug contact sub-assembly, the plug housing 110 is modified by replacing the plug contact assembly support structure 138 (FIG. 5) with another plug contact assembly support structure 905 as shown in FIG. 9. As can be seen in FIG. 9, the plug contact assembly support structure 905 includes a plurality of support walls 910 and insertion slots 915. Support walls 910 include retention tabs 930 for supporting and securing plug contact sub-assembly 800 (FIG. 8). In another embodiment, the plug housing 110 may be provided with one or more insertion slots 915 and corresponding support walls 910 corresponding to the number of plug contact sub-assemblies 800 used.

Figure 10A:
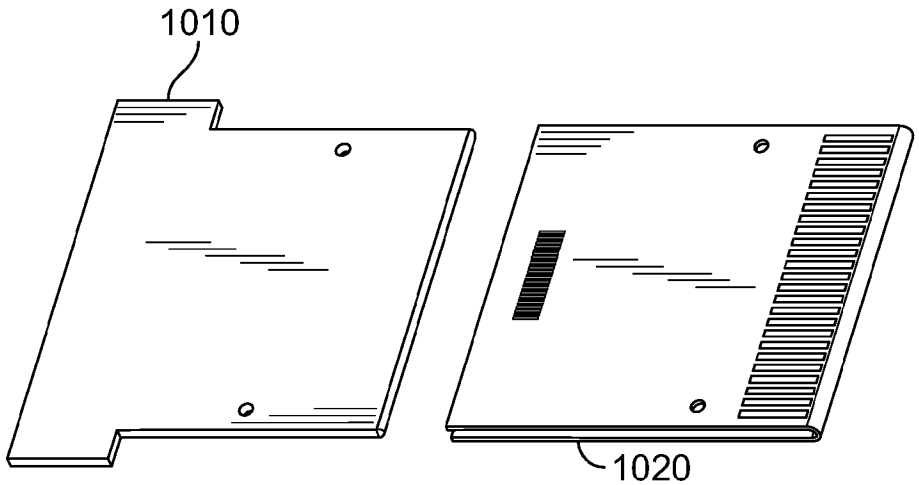
FIG. 10A is an exploded view of the plug contact sub-assembly of FIG. 10.
Figure 10:
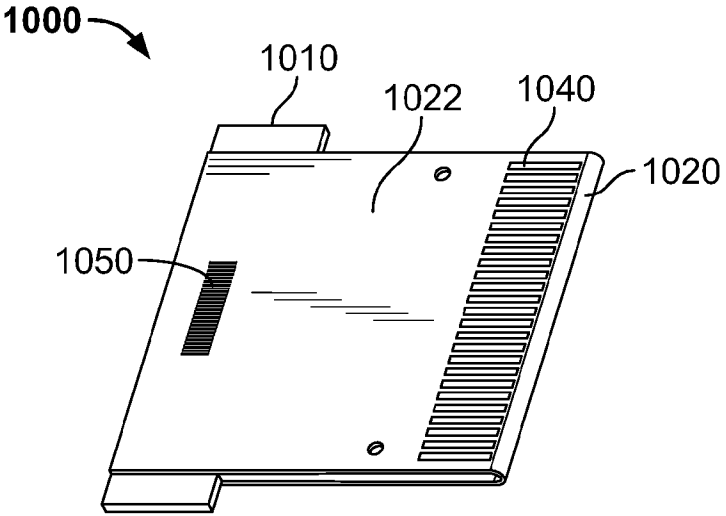
FIG. 10 is a perspective view of another exemplary plug contact sub-assembly according to the invention.
Figure 10B:
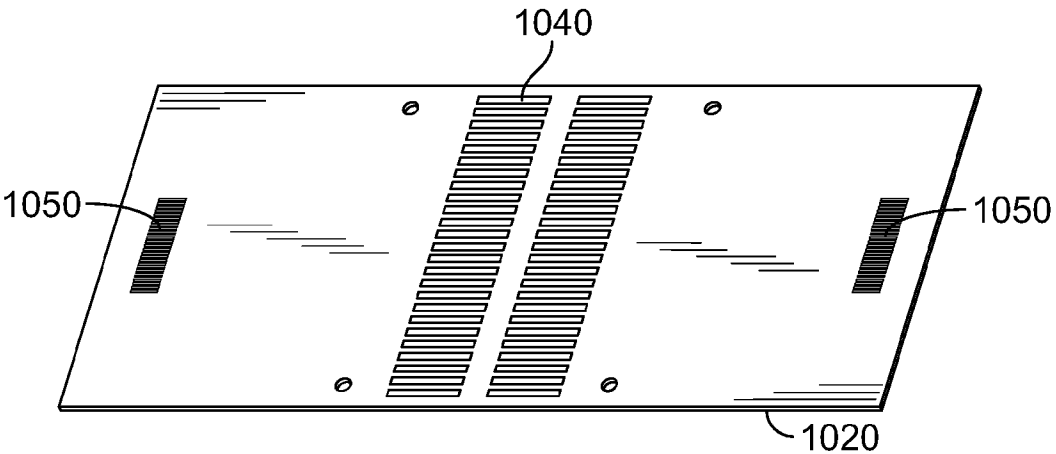
FIG. 10B is a perspective view of a flexible film, shown in a flat state, used in the plug contact sub-assembly of FIG. 10.

FIGS. 10 and 10A show yet another alternative plug contact sub-assembly 1000. Plug contact sub-assembly 1000 includes a support board 1010 and a flexible film contact assembly 1020. Flexible film contact assembly 1020 includes a first surface 1022 having a plurality of contacts 1040 disposed thereupon. The flexible film contact assembly 1020 also includes a second surface (not shown) opposite side surface 1022. The flexible film contact assembly 1020 further includes a plurality of conductive traces (not shown) providing an electrical path between the plurality of contacts 1040 and a plurality of contact pads 1050. The plurality of conductive traces may be disposed on the first surface 1022, second surface, between the first surface and the second surface, or any combination thereof. The plug contact sub-assembly 1000 is formed by applying the flexible film contact assembly 1020 to the support board 1010. The flexible film contact assembly 1020 may be applied to the support board 1010 by gluing or other known fastening methods. The plug contact sub-assembly 1000 is supported in the plug housing 110 by the plug contact assembly support structure 910 shown in FIG. 9.

Figure 11:
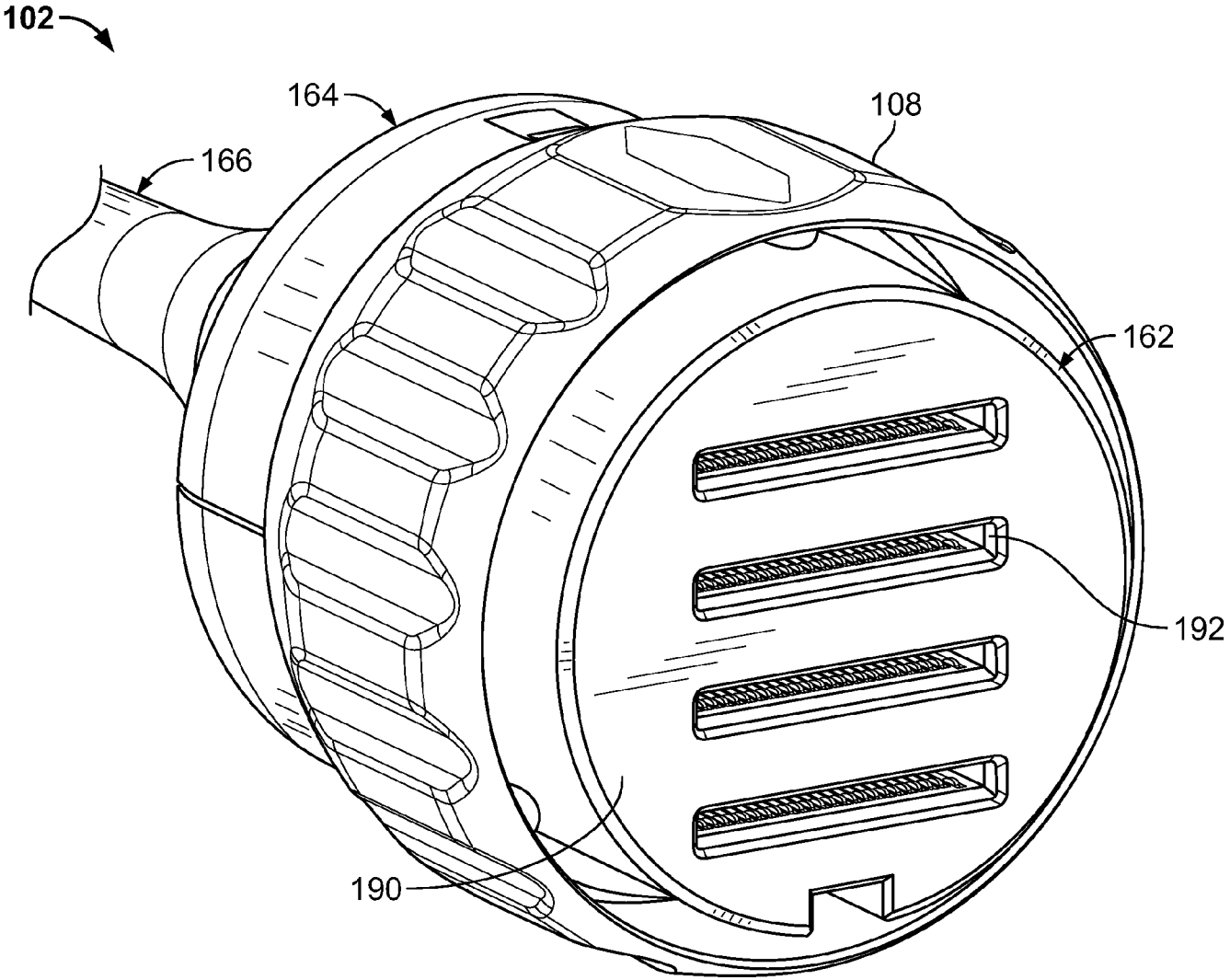
FIG. 11 is a front perspective view of an exemplary receptacle according to the invention.
Figure 12:
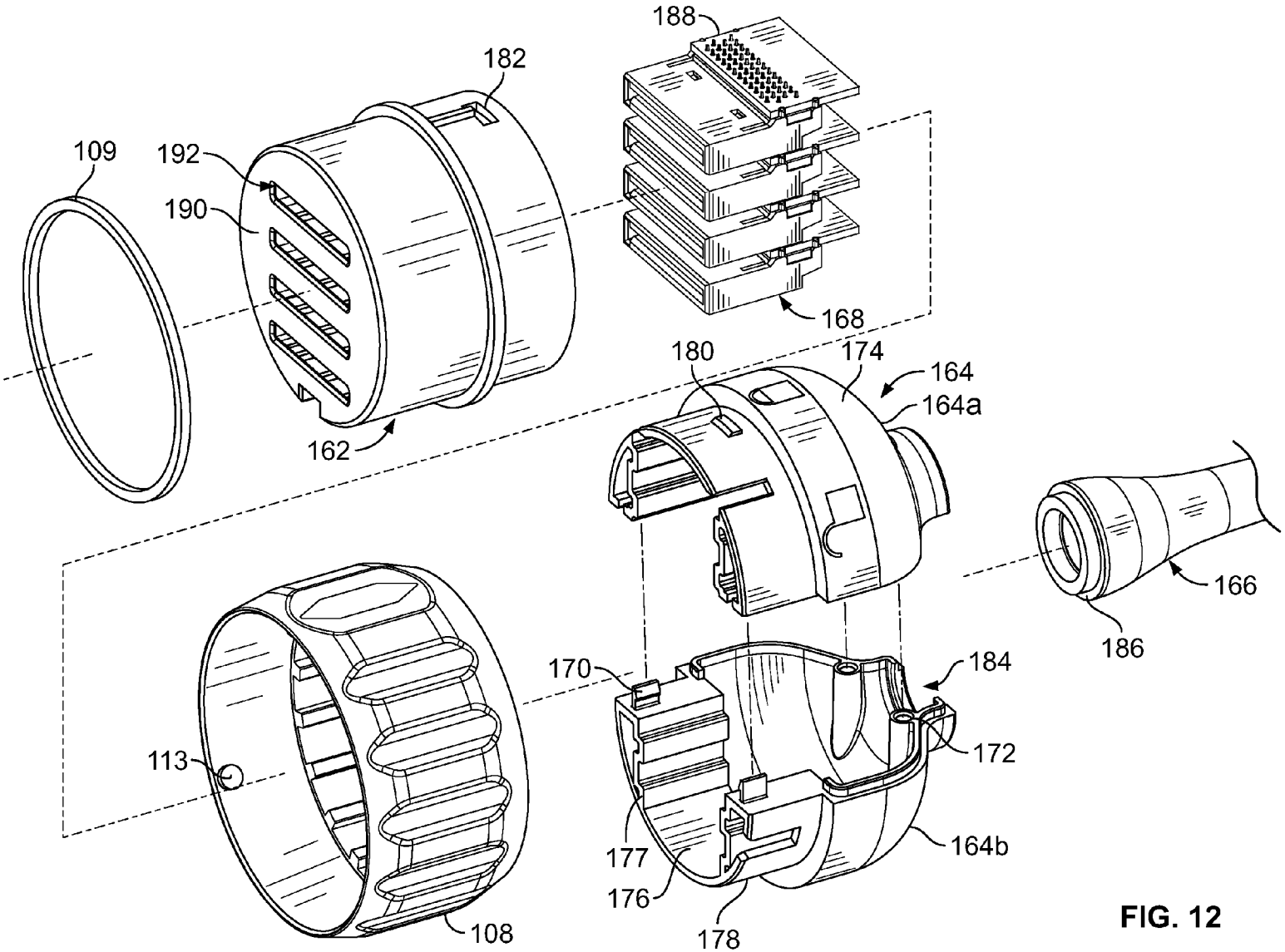
FIG. 12 is an exploded view of the receptacle of FIG. 11.

FIGS. 11 and 12 show receptacle 102 in greater detail. Receptacle 102 includes a receptacle housing gasket 109, a receptacle housing 162, a coupling ring 108, a receptacle housing shell 164, a flexible cable connector 166, and at least one receptacle contact sub-assembly 168. The receptacle housing gasket 109 provides an environmental seal between the receptacle 104 and the plug 102. The receptacle housing gasket 109 may be formed of any elastomeric material as would be appreciated by one of ordinary skill in the art. In another embodiment, when an electrical shield material is used as discussed below, the receptacle housing gasket may be formed by a conductive elastomeric material to provide both electrical conduction/EMI protection and environmental seal, or may be formed of a compliant metal if an environmental seal is not required.

In addition, in an another embodiment when the receptacle shell 164 and/or the receptacle housing 162 is provided with a plated electrical shield coating (not shown) as discussed in the additional embodiments discussed below, the plug housing gasket 109 can provide an electrical pathway between the receptacle shielding and the plug shielding.

The receptacle housing shell 164 includes a first receptacle housing shell portion 164*a* and a second receptacle housing shell portion 164*b*. The second receptacle housing shell portion 164*b* includes tabs 170 and openings 172 and the first receptacle housing shell portion 164*a* includes corresponding slots (not shown) and pins (not shown) for securing the second receptacle housing shell portion 164*b* and the first receptacle housing shell portion 164*a* together. In alternative embodiments, the first receptacle housing shell portion 164*a* and the second receptacle housing shell portion 164*b* may be provided with any corresponding combinations of tabs, slots, pins, screws, openings or other similar fasteners to secure the first receptacle housing shell portion 164*a* and the second receptacle housing shell portion 164*b* together as would be appreciated by one of ordinary skill in the art. In another embodiment, the receptacle housing shell 164 may be a single structure.

The receptacle housing shell 164 further includes an outer surface 174 and an inner surface 176. Receptacle contact sub-assembly support surfaces 177 are disposed on the inner surface 176. The receptacle housing shell 164 also includes a front engaging portion 178 having tabs 180 disposed thereupon (a similar tab 180 is present but not shown on the opposite side of the receptacle housing shell 164). The tabs 180 engage corresponding slots 182 (a similar slot 182 is present but not shown on the opposite side of the receptacle housing 162) in the receptacle housing 162 to secure the receptacle shell housing 164 to the receptacle housing 162. In alternative embodiments, the receptacle housing shell 164 and the receptacle housing 162 may be provided with any corresponding combinations of tabs, slots, pins, openings or other similar fasteners to secure the receptacle housing 162 and the receptacle shell housing 164 together as would be appreciated by one of ordinary skill in the art. Furthermore, in other embodiments, the engaging portion 178 may be provided over the receptacle housing 162 instead of being received within the receptacle housing 162 as in the exemplary embodiment.

The receptacle housing shell 164 further includes a rear opening 184 for receiving and securing flexible cable connector 166. In this exemplary embodiment, flexible cable connector 166 includes a generally circular groove 186 that is secured in the rear opening 184 when the first receptacle housing shell portion 164*a* and the second receptacle housing shell portion 164*b* are assembled to each other. In other embodiments, the flexible cable connector 166 and the plug housing shell 164 may be otherwise configured with clamps, pins, slots or other fasteners to secure the flexible cable connector 166 to the receptacle housing shell 164. Additionally, while the rear opening 184 and groove 186 are shown having a generally circular geometry, it should be appreciated by one of ordinary skill in the art that the rear opening 184 and groove 186 may have any shape, including, but not limited to square, rectangular, and oval. In another embodiment, groove 186 may contain a keying feature (not shown), with the rear opening 184 having a corresponding mating keying feature (not shown). In operation, a cable or wire having a plurality of conductors (not shown) would be provided through the flexible cable connector 166 and terminated to the plurality of spring contacts 200 (FIG. 14A) and/or other termination features as described below.

Figure 13:
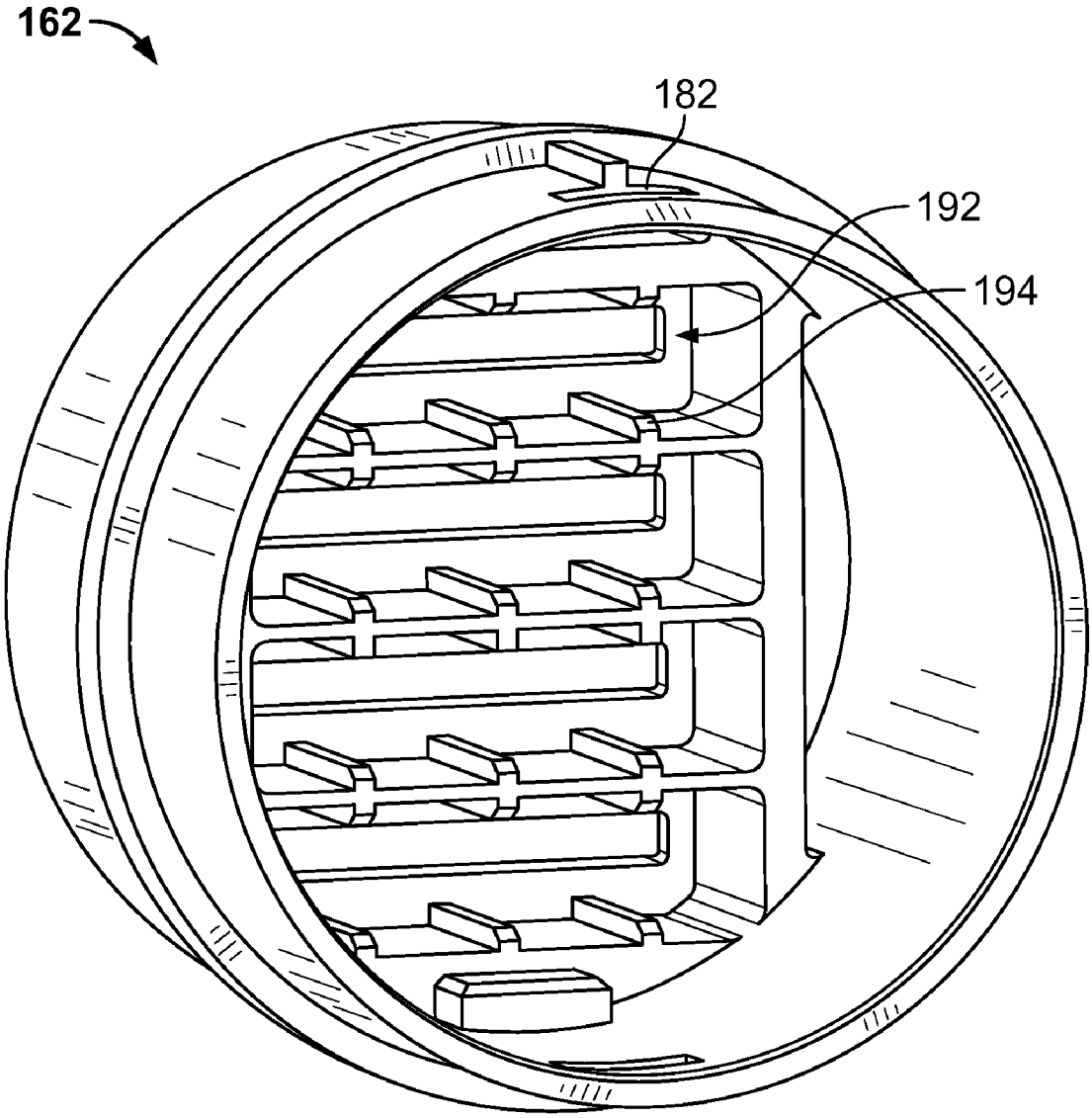
FIG. 13 is a rear view of an exemplary receptacle housing according to the invention.

As can be further seen in FIGS. 11 and 12, the receptacle housing 162 further includes a front receptacle housing surface 190 having spring contact assembly slots 192 therethrough. A rear view of the receptacle housing 162 showing the spring contact assembly slots 192 is shown in FIG. 13. As can be seen in FIG. 13, the spring contact assembly support slots 192 includes guide rails 194 configured to receive and support a spring contact sub-assembly 168. In this exemplary embodiment, the receptacle 102 includes four spring contact sub-assemblies 188. In another embodiment, the receptacle housing 162 may be provided with one or more slots 192 to receive and support a corresponding number of spring contact sub-assemblies 168. In yet another embodiment, not all slots 192 may necessarily support a spring contact sub-assembly 168, or in other words, be left open.

Figure 14A:
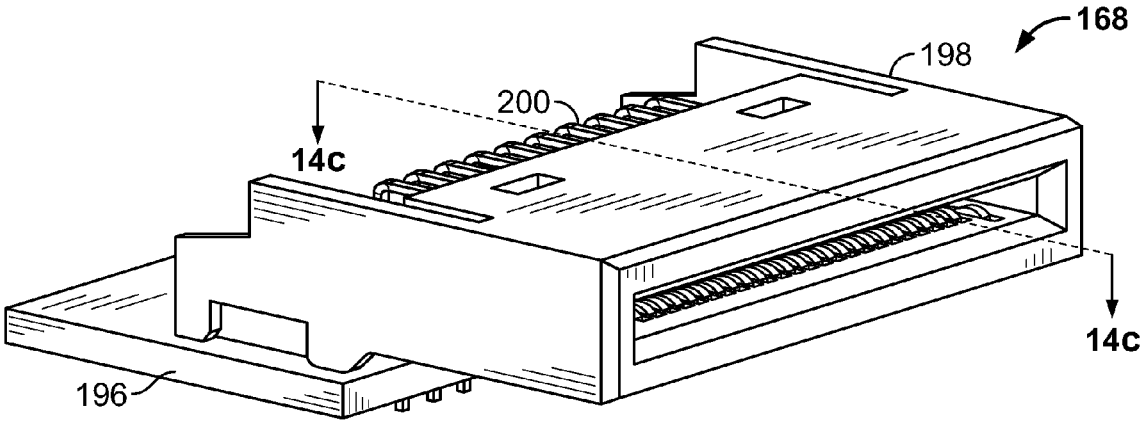
FIG. 14A is a perspective view of an exemplary spring contact sub-assembly according to the invention.
Figure 14C:
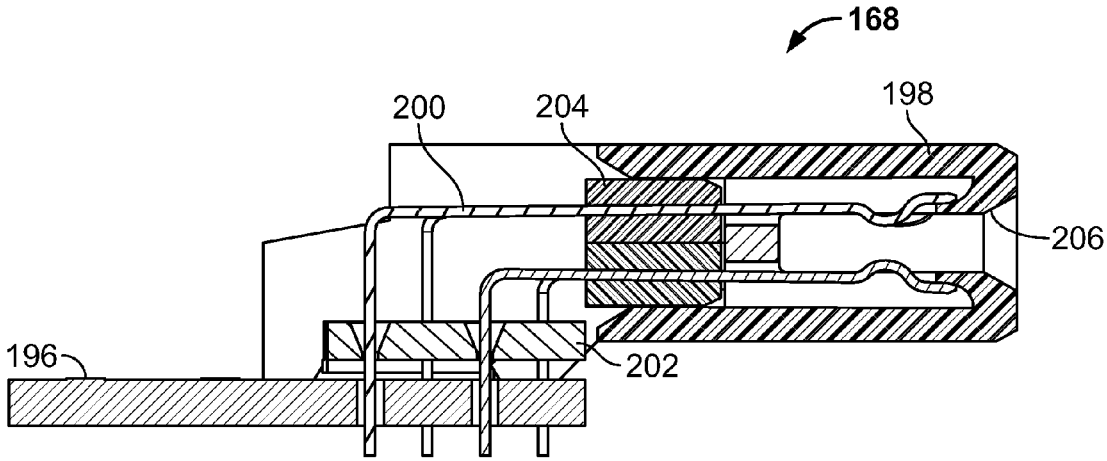
FIG. 14C is a cross-sectional view of FIG. 14A taken along line 14C-14C.
Figure 14B:
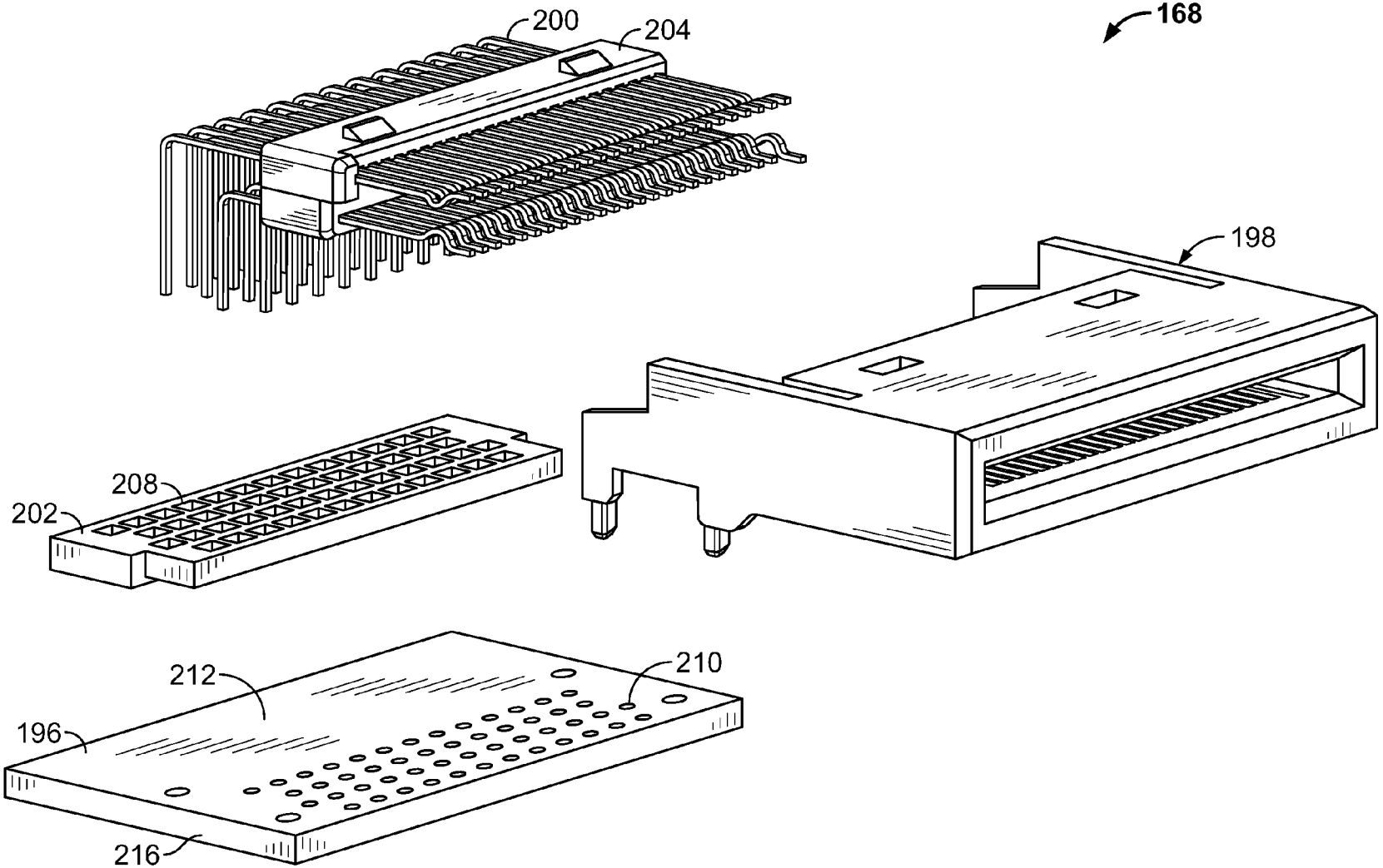
FIG. 14B is an exploded view of the spring contact sub-assembly of FIG. 14A.

A spring contact sub-assembly 168 is shown in greater detail in FIGS. 14A, 14B and 14C. The spring contact sub-assembly 168 includes a sub-assembly base 196, a contact support housing 198, a plurality of spring contacts 200, and a contact alignment spacer 202. The spring contact sub-assembly 168 may include an optional spring contact assembler 204. The sub-assembly base 196 includes a top surface 212, a bottom surface (not shown), and an edge surface 216. In another embodiment, the spring contact assembler 204 may also be overmolded with the plurality of spring contacts 200. The contact support housing 198 includes a retaining surface 206 (FIG. 14D) for receiving and supporting the plurality of spring contacts 200 in a preloaded configuration. The retaining surface 206 forces the plurality of spring contacts 200 open beyond the spring contacts natural free state but not to the total amount of travel when mated with the corresponding plurality of plug contacts 150. The plurality of spring contacts 200 are further received through a plurality of openings 208 in the contact alignment spacer 202 prior to the plurality of spring contacts 200 being received through yet another plurality of openings 210 in the sub-assembly base 196. The contact alignment spacer 202 serves as an alignment aid for receiving the plurality of spring contacts 200 in the sub-assembly base 196. After the plurality of spring contacts 200 are received through the plurality of openings 210 in the sub-assembly base 196, the plurality of spring contacts 200 are terminated to traces, contact pads, conductive paths (not shown), and/or any combination thereof provided on the top surface 212, bottom surface (not shown) and/or edge surface 216 and/or any combination thereof of the sub-assembly base 196. A plurality of conductors (not shown), provided to the receptacle 104 through flexible cable connector 166, would correspondingly be terminated to the traces, contact pads, conductive paths, the plurality of spring contacts 200 or any combination thereof as would be appreciated by one of ordinary skill in the art.

Figure 14D:
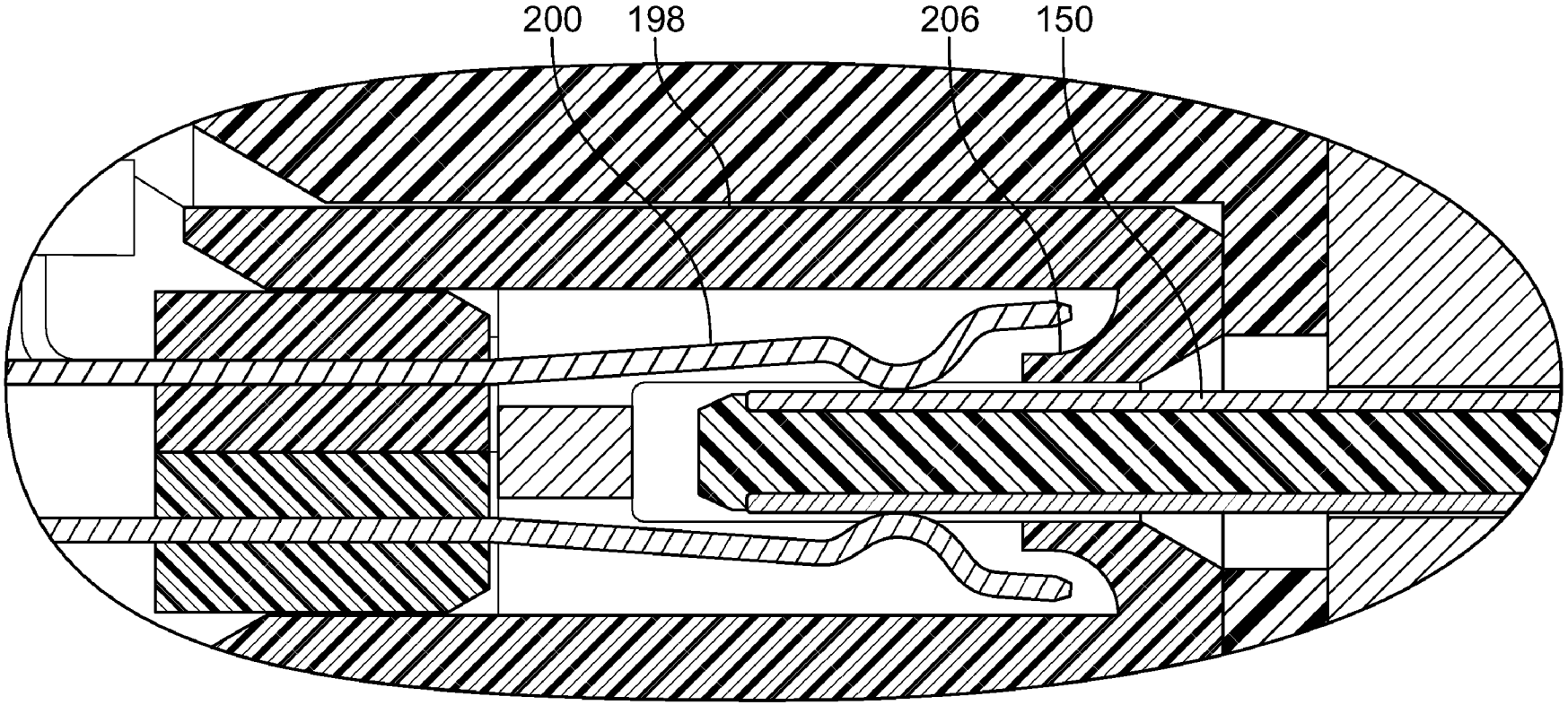
FIG. 14D is an expanded view of a portion of FIG. 14C with a plug contact inserted.

FIG. 14D shows an enlarged view of a portion of FIG. 14C including a contact 150 inserted therein. As can be seen in FIG. 14D, the spring contact 200 has been expanded by receiving contact 150 so as to disengage the spring contact 200 from the retaining surface 206, thereby assuring a positive electrical connection between the contact 150 and spring contact 200.

Figure 15:
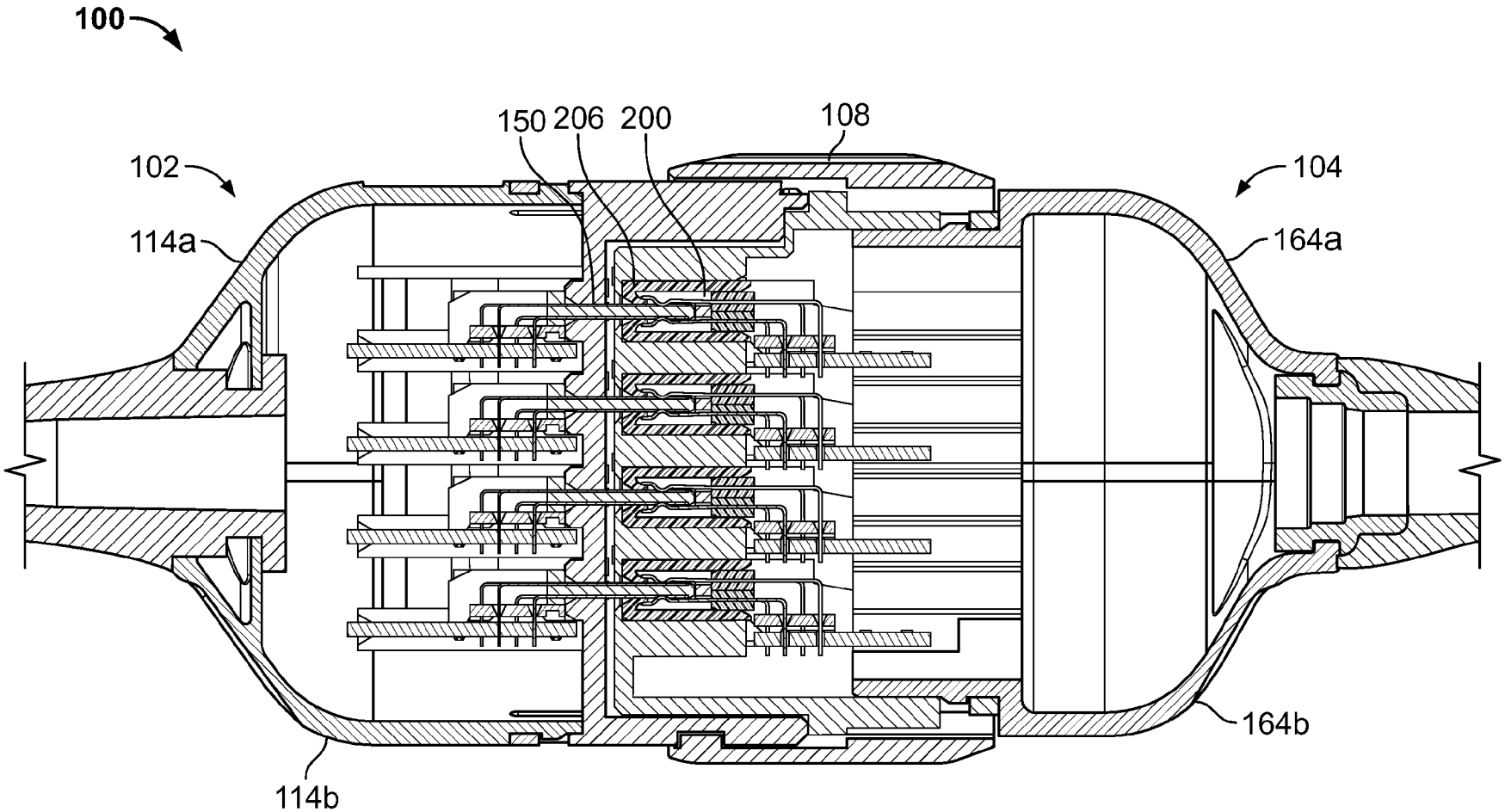
FIG. 15 is a cross sectional view of the mated connector of FIG. 1 taken along line 15-15.

A cross sectional view 4-4 of the mated connector 100 of FIG. 1 taken along line 15-15 is shown in FIG. 15. As can be seen in FIG. 15, when the plug 102 and receptacle 104 are mated, contacts 150 are mated to corresponding spring contacts 200.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector, comprising:

a plug comprising a plug housing having a plug contact assembly support structure, a plug contact sub-assembly disposed within the plug contact assembly support structure, a plug housing shell attached to a rear portion of the plug housing and disposed around the plug contact assembly support structure, and a plurality of contacts received and supported in the plug contact sub-assembly; and a receptacle comprising a receptacle housing having a receptacle contact assembly support structure, a receptacle contact sub-assembly disposed within the receptacle contact assembly support structure, a receptacle housing shell attached to a rear portion of the receptacle housing, and a plurality of spring contacts received and supported in the receptacle contact sub-assembly;

wherein the plurality of contacts are received in a plug sub-assembly base of the plug contact sub-assembly to provide an electrical connection therefrom; and wherein the plug housing further comprises an outer surface having bayonet slots disposed thereupon and the receptacle further comprises a coupling ring disposed around the receptacle housing, the coupling ring comprising bayonet pins configured to engage the bayonet slots and axially draw the plug into a fully mated position with the receptacle when the coupling ring is rotated.

2. The connector of claim 1, wherein the receptacle further comprises a receptacle housing gasket.

3. The connector of claim 2, wherein the receptacle housing gasket comprises a conductive elastomeric material.

4. The connector of claim 1, wherein the plurality of spring contacts are preloaded with an opening force.

5. The connector of claim 1, wherein the plurality of spring contacts are preloaded with a spring force by tabs in the receptacle contact sub-assembly.

6. The connector of claim 1, wherein the plurality of contacts are a plurality of stitched contacts.

7. The connector of claim 1, wherein the plurality of contacts are disposed on a printed circuit board.

8. The connector of claim 7, further comprising an overmold protecting the plurality of contacts.

9. The connector of claim 1, wherein the plurality of contacts are disposed on a flexible film contact assembly.

10. The connector of claim 1, wherein an interior surface of the plug housing shell is coated with an electrically shielding material.

11. The connector of claim 1, wherein an interior surface receptacle housing shell is coated with an electrically shielding material.

12. The connector of claim 1, wherein an interior surface of the plug housing is coated with an electrically shielding material.

13. The connector of claim 1, wherein an interior surface of the receptacle housing is coated with an electrically shielding material.

14. The connector of claim 1, wherein the plug contact sub-assembly further comprises a plug contact support housing, and the plurality of contacts are supported by the plug contact support housing and terminated to conductive paths on the plug sub-assembly base.

15. The connector of claim 14, wherein the plug sub-assembly base is a printed circuit board.

16. The connector of claim 1, further comprising a plurality of a plug contact sub-assemblies and corresponding plurality of receptacle contact sub-assemblies.

* * * * *